United States Patent [19]

Yamato et al.

[11] Patent Number: 4,473,832

[45] Date of Patent: Sep. 25, 1984

[54] PRESSURE-SENSITIVE RECORDING SHEETS

[75] Inventors: Noboru Yamato; Akira Hasegawa; Hiroaki Umeda; Mamoru Suzuki, all of Tokyo, Japan

[73] Assignee: Jujo Paper Co., Ltd., Tokyo, Japan

[21] Appl. No.: 442,966

[22] Filed: Nov. 19, 1982

[30] Foreign Application Priority Data

Dec. 8, 1981 [JP] Japan ..... 56-196384

[51] Int. Cl.[3] ..... B41M 5/22

[52] U.S. Cl. ..... 346/209; 346/212; 346/216; 346/217; 346/221; 346/225

[58] Field of Search ..... 282/27.5; 427/150, 151; 428/411, 488, 320.4, 320.6, 320.8, 537, 914

[56] References Cited

U.S. PATENT DOCUMENTS 4,421,344 12/1983 Ikezawa et al. ..... 282/27.5

FOREIGN PATENT DOCUMENTS 0042910 4/1978 Japan ..... 346/225
0108706 8/1979 Japan ..... 346/212
0037189 4/1981 Japan ..... 346/212

*Primary Examiner*—Bruce H. Hess
*Attorney, Agent, or Firm*—Koda and Androlia

[57] ABSTRACT

Pressure-sensitive recording sheets which comprise at least a transfer sheet having on its one side a coating including microcapsules containing as color-former black color-forming fluoran dye and a color-developing sheet having on its one side a color-developer layer containing at least activated clay, zinc carbonate and thiourea compound. The pressure-sensitive recording sheets of this invention provide pure black color image having high-color density, excellent light fastness and less color change with the lapse of time.

5 Claims, No Drawings

PRESSURE-SENSITIVE RECORDING SHEETS

BACKGROUND OF THE INVENTION

1. Field of the Invention

This invention relates to pressure-sensitive recording sheets. More particularly, this invention relates to pressure-sensitive developing sheets which can provide recorded black color images having a high color intensity and excellent light fastness.

2. Prior Art

Generally, pressure-sensitive recording sheets are composed of a top sheet coated on its backside with microcapsules containing electron-donating colorless or light-colored color-forming dyes dissolved in organic solvent (capsule oil) and an under sheet having on its front side a developing layer containing electron-accepting developing agents. These two sheets are laid so that the two coated surfaces are faced with each other and arranged so that the printed records are produced in such a way that when pressure is applied with ball-point pen or typewriter, the capsules in the pressed area are ruptured and the emerged capsule oil containing color-forming dyes is transferred to the developing layer and brings about color-forming reaction. Moreover, a plurality of copies can be obtained by using intermediate sheets each of which has a developing layer on its front side and microcapsules on its back side, sandwiched between the top and under sheets. Accordingly, the developing sheets of this invention include intermediate sheets in addition to the above-mentioned under sheet.

The developing agents which are conventionally known include inorganic solid acids such as activated clay (shown in, for example, the Japanese Patent Publication No. 7622/1966), attapulgite (shown in, for example, the U.S. Pat. No. 2,712,507), substituted phenols and diphenols (shown in, for example, the Japanese Patent Publication No. 9309/1965), p-substituted phenol/formaldehyde polymers (shown in, for example, the Japanese Patent Publication No. 20144/1967), aromatic carboxylic acid metal salts (shown in, for example, the Japanese Patent Publication No. 10856/1974), and 2,2'-bisphenol sulfone compounds (shown in, for example, the Japanese Patent Laid-open No. 106313/1979).

Of these developing agents, the activated clay is prepared by treating Japanese acid clay or the like with a mineral acid to elute iron or other basic components and increase the specific surface area. The activated clay having a specific surface area of not less than 200 $m^2/g$ is thought to have a particularly excellent developing effect. Such an activated clay is advantageous in that it is very inexpensive as compared with those of the above-mentioned organic developing agents.

With respect to the color of a developed color image of a pressure-sensitive manifold sheet, blue color-forming manifold sheets prepared by using, as a developing agent, Crystal Violet Lactone (CVL), Benzoyl Leuco Methylene Blue (BLMB) or the like were initially used. However, as demands of the market for black-color forming manifold sheets grew greater, a method for mixing at least two dyes having different developed colors has been adopted in order to produce black color recorded images, as disclosed, for example, in the Japanese Patent Publication Nos. 4698/1970 and 4614/1971. For example, the black color-forming dyes can be obtained by combining dyes having developed colors which are in a relationship of complementary colors or which constitute primary colors such as blue/yellowish orange, blue/yellow/yellowish orange/red, and blue/-green/red.

This system is chiefly applied to pressure-sensitive manifold sheets in which an inorganic solid acid such as activated clay or attapulgite is used. However, because the dyes have different rates of color formation and different fastness to the light, temperature or moisture, they have a drawback that the developed color changes with the lapse of time when the images are further exposed to the sunlight or ultraviolet rays during the period from the initial color formation to the final color formation or when they are stored for a long time. Furthermore, the following problems are frequently encountered: the color mixing and matching requires much time; because many kinds of dyes are used in quantities, the cost of sheets become higher; and the dissolution of dyes in a solvent (capsule oil) shall be difficult.

In order to eliminate these drawbacks, the fluoran dyes which can form a black color by itself have been developed.

Exemplary of these dyes are 3-diethylamino-6-methyl-7-anilinofluoran, 3-(N-cyclohexly-N-methyl-amino)-6-methyl-7-anilonofluoran, 3-diethylamino-6-methyl-7-(o,p-dimethylanilino)-fluoran and 3-(N-ethyl-p-toluidino)-6-methyl-7-anilinofluoran. These dyes have an advantage that when the organic developing agent such as p-substituted phenol/formaldehyde polymer, aromatic carboxylic acid metal salt or 2,2'-bisphenol sulfone compound metal salt is used as a developing agent, the above dyes alone or in combination with small amount of blue, red or the like color dyes acting as a complementary color dye can produce black developed color images whose color changes little with the lapse of time.

On the other hand, these dyes have disadvantages in that when they are used in combination with inorganic developing agent such as activated clay, the reddish black or greenish black color appears, and when they are exposed to the sunlight or ultraviolet rays, the developed images discolor or fade to reddish brown, as a result, the developed images with a stable color cannot be obtained.

Accordingly, although the activated clay is inexpensive and has a superior developing performance as compared with organic developing agents, there has been no choice but to adopt the above-mentioned mixed dye system in order to obtain a black color on clay type developer.

SUMMARY OF THE INVENTION

It is the object of the present invention to provide pressure-sensitive recording sheets in which a color-developing sheet, when used in combination with a sole black color-forming fluoran dye, forms developed images having pure black color, high color intensity, excellent light fastness and less color change with the lapse of time.

The above and other related objects can be accomplished by using at least a transfer sheet (top sheet) having on its back side a coating including microcapsules containing black color-forming fluoran dye of the following formula (I) and a color-developing sheet (bottom sheet) having on its front side a developing layer containing at least activated clay, zinc carbonate and thiourea compound selected from the group consisting of thiourea, trimethylthiourea, diethylthiourea, dibutylthiourea, dilaurylthiourea, ethylenethiourea and diphenylthiourea:

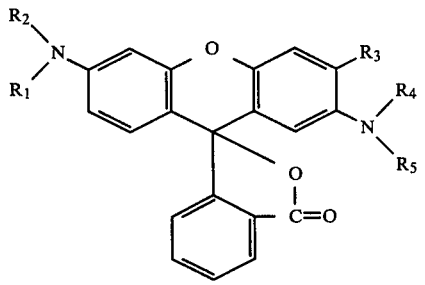

(I)

wherein $R_1$, $R_2$, $R_4$ and $R_5$ represent each hydrogen, alkyl group, alicyclic group. aryl group, aralkyl group or derivative thereof substituted with halogen, alkyl group, haloalkyl group, alicyclic group, aralkyl group, hydroxyl group, alkoxy group, acyl group, amino group, substituted amino group, nitro group. $R_1$ and $R_2$, and $R_4$ and $R_5$ may be combined with each other to form a ring or rings, $R_3$ represents hydrogen, halogen, alkyl group, alkoxyalkyl group, haloalkyl group, aralkyl group or alkoxy group.

DETAILED DESCRIPTION OF THE INVENTION

The black color-forming dyes which can be used in this invention are: 3-(N-ethyl-N-isoamyl) amino-6-methyl-7-anilinofluoran, 3-piperidino-6-methyl-7-anilinofluoran, 3-pyrrolidino-6-methyl-7-anilinofluoran, 3-(N-cyclohexyl-N-methyl-amino)-6-methyl-7-amilinofluoran, 3-diethylamino-7-(m-trifluoromethylanilino) fluoran, 3-(N ethyl-p-toluidino)-6-methyl-7-anilinofluoran, 3-(N-ethyl-p-toluidino)-6-methyl-7-(p-methylanilino) fluoran, 3-diethylamino-6-methyl-7-anilinofluoran, 3-diethyl-amino-6-methyl-7-(p-n-butylanilino) fluoran, 3-diethylamino-6-methyl-7-(o,p-dimethylanilino) fluoran, 3-diethylamino-6-methyl-7-(o,p-dimethylanilino) fluoran, 3-diethylanimo-6-methyl-7-(o-methyl-p-chloroanilino) fluoran, 3-diethylamino-6-methyl-7-(m-methyl-p-chloroanilino) fluoran, 3-diethylamino-7-(o-chloroanilino)-fluoran, 3-diethylamino-7-cyclohexylanilinofluoran and 3-pyrrolidino-7-cyclohexylanilinofluoran.

These days are dissolved in the organic solvents and encapsulated by a method such as coacervation process (shown in, for example, the U.S. Pat. No. 2,800,457), interfacial polymerization (shown in, for example, the Japanese Patent Publication No. 19578/1963) or in-situ polymerization (shown in, for example, the Japanese Patent Publication No. 45133/1974). Then, the microcapsules are coated on the base sheet to prepare a transfer sheet.

The developing sheet of this invention used in combination with the above transfer sheet is prepared by providing a developing layer containing activated clay, zinc carbonate and a thiourea compound on the base sheet. By using zinc carbonate and thiourea compound in addition to the activated clay, onto the developing sheet, it has become possible to obtain pure-black recorded color images having high color intensity through the application of the features of the above-mentioned sole black color-forming fluoran dye, moreover, the markedly improved light fastness and stability of the developed color have been achieved (these properties of the above-mentioned dyes were hitherto not satisfactory).

In this invention, the thiourea compound performs to obtain a pure-black color, to improve light fastness and to decrease the change of a developed color. The thiourea compound used in this invention are: thiourea, trimethylthiourea, diethylthiourea, dibutylthiourea, dilaurylthiourea, ethylenethiourea and diphenylthiourea. Preferable among them are trimethylthiourea, diethylthiourea, dibutylthiourea, and diphenylthiourea.

Zinc carbonate has an effect to increase a color intensity and to improve the resistance to the light fade and color change. As zinc carbonate which can be used in this invention, there can be mentioned zinc carbonate, and basic zone cabonate which are available in the market.

Zinc oxide is unsuitable for this invention because the recorded image exhibits low color intensity and poor light fastness and becomes reddish brown when exposed to the sunlight or ultraviolet rays.

Zinc phosphate provides a recorded image of low intensity, though it has good light fastness and less color changes. Effects of combined use of zinc carbonate and thiourea compound of this invention are prominent, that is, the combined use brings a recorded image of pure-black color, having a high color intensity, excellent light fastness and less color change.

The binders used in the developing layer are natural or synthetic high-molecular substances such as starch, carboxymethylcellulose, methylcellulose, gelatin, gum arabic, polyvinyl alcohol, casein and styrene/butadiene copolymer latexes. The inorganic pigment are natural or synthetic inorganic pigments such as clay, talc, kaolin, calcium carbonate, basic magnesium carbonate, barium sulfate, barium carbonate, aluminum hydroxide and zinc white.

The developing sheet of this invention preferably has a developing layer including 100 parts by weight of activated clay, 3 to 20 parts by weight of zinc carbonate, and 1 to 30 parts by weight of thiourea compound and further containing 10 to 40 parts by weight of binder per 100 parts by weight of total solid compounds. The developing layer preferably has a coating weight of 3 to 10 g/cm$^2$.

This invention is illustrated in more detail below with reference to examples.

EXAMPLE 1

Color-Forming Transfer Sheet

Twenty (20) parts by weight of gelatin, isoelectric point pH 8, was dissolved in 160 parts by weight of water. In this solution was added and emulsified 80 parts by weight of solvent oil prepared by dissolving 4% of 3-diethylamino-6-methyl-7-anilinofluoran in alkylated naphthalene. To this emulsion was added a solution of 20 parts of gum arabic in 160 parts by weight of water, and then 550 parts by weight of water was added. The agitation was continued. Then a 10% acetic acid solution was added drop by drop to the mixture to adjust the pH to 4.4 and cause coacervation. Up to this, the temperature of the mixture was kept at 50° C. or higher.

After cooling the mixture to 10° C., 3.8 parts by weight of 37% formalin was added as a curing agent to the solution. The resulting mixture was agitated and then adjusted to a pH of 9 by adding a 20% aqueous solution of caustic soda.

A transfer sheet was prepared by coating on a base sheet, 40 g/m$^2$, with the thus-produced microcapsules containing color-forming dye at coated weight of 5 g/m$^2$.

Developing Sheet

To 3000 parts by weight of water was added 1 part by weight of sodium pyrophosphate as a dispersent. To this solution was dispersed 100 parts by weight of activated clay and then further added 19 parts by weight of zinc carbonate. Next, to this dispersion was added 7 parts by weight of diethylthiourea. The diethylthiourea had been finely ground by an attritor, sand grinder or the like. Next, to this mixture was added 60 parts by weight of a styrene/butadiene copolymer latex (solids 50%), and the resulting mixture was adjusted to a pH of 7 by adding an aqueous solution of caustic soda.

A developing sheet was prepared by coating on a base sheet (40 g/m$^2$) with the thus-prepared coating at the coated weight of 7 g/m$^2$.

EXAMPLES 2 THROUGH 8

Transfer Sheet

The color-forming transfer sheets of Example 1 were used as such.

Developing Sheet

Similarly to Example 1, the developing sheets were prepared by using various thiourea compounds and a zinc carbonate, in various amounts shown in Table 1.

COMPARATIVE EXAMPLES 1 THROUGH 11

Transfer Sheets

The color-forming transfer sheets of Example 1 were used as such.

Developing Sheets

Similarly to Example 1, the developing sheets were prepared. The developing sheets contain the components shown in Table 1. Thiourea was dissolved in a dispersion of activated clay, since the thiourea is soluble in water.

The color intensity, developed color, light fastness and color changes were measured according to the following methods by using both the transfer sheets and the developing sheets obtained in Example 1 through 8 and Comparative Examples 1 through 11.

(1) Color intensity: The transfer sheet is laid upon the developing sheet and the two sheets are typed so as to develop the color. After 24 hours, the reflectance is measured by the Hunter reflectometer (manufactured by Toyo Precision Machinery Co.) with an amber filter. The color intensity is expressed in terms of a reflectance before color formation, $I_o$, and a refrectance after 24 hours from color formation, $I_1$.

$$\text{Color Intensity} = \frac{I_o - I_1}{I_o} \times 100\%$$

Higher color intensity is so much preferable.

(2) Developed Color: The developed color on the developing sheet developed by the method (1) is evaluated after 24 hours by visual observation.

(3) Light fastness: The developing sheet developed by the method (1) is exposed to the sunlight for two hours and evaluated for the degree of fading.

(4) Color change: The developing sheet developed by the method (1) is exposed to the sunlight for two hours and evaluated by visually observing the changes in the developed color.

The test results are shown in Table 1.

TABLE 1

| Example or Comparative Example | Activated Clay Parts by Weight | Thiourea Compound (Parts by weight) | | zinc carbonate Parts by Weight | Other Inorganic Pigments (Parts by weight) | |
|---|---|---|---|---|---|---|
| Example 1 | 100 | Diethylthiourea | 7 | 19 | | |
| Example 2 | " | Diethylthiourea | 20 | 20 | | |
| Example 3 | " | Diethylthiourea | 28 | 14 | | |
| Example 4 | " | Diethylthiourea | 12 | 6 | | |
| Example 5 | " | Trimethylthiourea | 20 | 10 | | |
| Example 6 | " | Diphenylthiourea | 19 | 7 | | |
| Example 7 | " | Diphenylthiourea | 7 | 19 | | |
| Example 8 | " | Dibutylthiourea | 10 | 10 | | |
| Comparative Example 1 | " | | | | | |
| Comparative Example 2 | " | | | | Kaolin | 25 |
| Comparative Example 3 | " | | | 25 | | |
| Comparative Example 4 | " | | | | Zinc oxide | 25 |
| Comparative Example 5 | " | | | | Calcium carbonate | 25 |
| Comparative Example 6 | " | Diethylthiourea | 25 | | | |
| Comparative Example 7 | " | Trimethylthiourea | 25 | | | |
| Comparative Example 8 | " | Dilaurylthiourea | 25 | | | |
| Comparative Example 9 | " | Ethylenethiourea | 25 | | | |
| Comparative Example 10 | " | Thiourea | 25 | | | |
| Comparative Example 11 | " | Diethythiourea | 15 | | Zinc phosphate | 5 |

| Example or Comparative Example | Color Intensity | Developed Color | Light Fastness | Color Change |
|---|---|---|---|---|
| Example 1 | 40 | Black | Good | Black |

TABLE 1-continued

| | | | | |
|---|---|---|---|---|
| Example 2 | 39 | " | " | " |
| Example 3 | 38 | " | " | " |
| Example 4 | 39 | " | " | " |
| Example 5 | 38 | " | " | " |
| Example 6 | 39 | " | " | " |
| Example 7 | 40 | " | " | " |
| Example 8 | 38 | " | " | " |
| Comparative Example 1 | 46 | Reddish Black | Poor | Reddish brown |
| Comparative Example 2 | 41 | " | " | " |
| Comparative Example 3 | 45 | " | Rather poor | Dark brown |
| Comparative Example 4 | 39 | " | Poor | Reddish brown |
| Comparative Example 5 | 39 | " | " | " |
| Comparative Example 6 | 34 | Black | Good | Black |
| Comparative Example 7 | 33 | " | " | " |
| Comparative Example 8 | 38 | Slightly reddish black | " | Reddish brown |
| Comparative Example 9 | 34 | " | Rather poor | " |
| Comparative Example 10 | 41 | " | Good | Black |
| Comparative Example 11 | 34 | Black | " | " |

As is apparent from Table 1, Examples 1 through 8 provide high color intensity, pure black-color formation, good light fastness and less color changes.

On the contrary, Comparative Examples 1 through 5 provide reddish-black-color formation and poor light fastness and/or more color changes, though they have high color intensity.

Comparative Examples 6 through 11 have pure black-color formation or slightly-reddish-black-color formation but provide low color intensity. According to these test results, it is apparent that the pressure-sensitive sheets of this invention are superior in quality.

We claim:

1. Pressure-sensitive recording sheets which form a colored image on contact of color-former with color-developer, said pressure-sensitive sheets comprising at least a transfer sheet having on its one side a transfer coating including microcapsules containing black color-forming fluoran dye of the general formula (I) and a color-developing sheet having on its one side a color-developer layer containing at least activated clay, zinc carbonate and thiourea compound selected from the group consisting of thiourea, trimethylthiourea, diethylthiourea, dibutylthiourea, dilaurylthiourea, ethylenethiourea and diphenylthiourea:

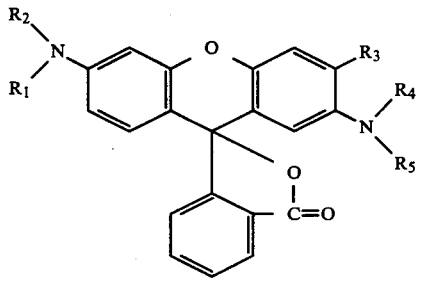

(I)

wherein $R_1$, $R_2$, $R_4$ and $R_5$ represent each hydrogen, an alkyl group, alicyclic group, aryl group, aralkyl group or derivative thereof substituted with halogen, alkyl group, haloalkyl group, alicyclic group, aralkyl group, hydroxyl group, alkoxy group, acyl group, amino group, substituted amino group, nitro group; $R_1$ and $R_2$, and $R_4$ and $R_5$ may be combined with each other to form a ring or rings; $R_3$ represents hydrogen, halogen, alkyl group, alkoxyalkyl group, haloalkyl group, aralkyl group or alkoxy group.

2. Pressure-sensitive recording sheets according to claim 1, wherein said thiourea compound is at least one member selected from the group consisting of trimethylthiourea, diethylthiourea, dibutylthiourea and diphenylthiourea.

3. Pressure sensitive recordings sheets according to claim 1, wherein said color-developing layer comprises 3 to 20 parts by weight of a zinc carbonate and 1 to 30 parts by weight of said thiourea compound per 100 parts by weight of activated clay.

4. Pressure-sensitive recording sheets according to claim 1, wherein said black color-forming fluoran dye is at least one member selected from the group consisting of 3-(N-ethyl-N-isoamyl) amino-6-methyl-7-anilinofluoran, 3-piperidino-6-methyl-7-anilinofluoran, 3-pyrrolidino-6-methyl-7-anilinofluoran, 3-(N-cyclohexyl-N-methyl-amino)-6-methyl-7-anilinofluoran, 3-diethylamino-7-(m-trifluoromethylanilino) fluoran, 3-(N-ethyl-p-toluidino)-6-methyl-7-anilinofluoran, 3-(N-ethyl-p-toluidino)-6-methyl-7-(p-methylanilino) fluoran, 3-diethylamino-6-methyl-7-anilinofluoran, 3-diethyl-amino-6-methyl-7-(p-n-butylanilino) fluoran, 3-diethylamino-6-methyl-7-(o, m-dimethylanilino) fluoran, 3-diethylanimo-6-methyl-7-(o, p-dimethylanilino) fluoran, 3-diethylamino-6-methyl-7-(o-methyl-p-chloroanilino) fluoran, 3-n-diethylamino-6-methyl-7-(m-methyl-p-chloroanilino) fluoran, 3-diethylamino-7-(o-choroanilino)-fluoran, 3-diethylamino-7-cyclohexylanilinofluoran and 3-pyrrolidino-7-cyclohexylanilinofluoran.

5. Pressure-sensitive recording sheets according to claim 1, wherein said color-developing layer has a coating weight of 3 to 10 g/cm$^2$.

* * * * *